US006866719B1

(12) United States Patent
Crane

(10) Patent No.: US 6,866,719 B1
(45) Date of Patent: Mar. 15, 2005

(54) APPARATUS AND METHOD FOR COATING AN ARTICLE

(75) Inventor: Michael Harry Crane, Alpharetta, GA (US)

(73) Assignee: C&S Automated Systems, Inc., Alpharetta, GA (US)

( * ) Notice: Subject to any disclaimer, the term of this patent is extended or adjusted under 35 U.S.C. 154(b) by 165 days.

(21) Appl. No.: 10/205,183

(22) Filed: Jul. 24, 2002

Related U.S. Application Data

(60) Provisional application No. 60/307,987, filed on Jul. 26, 2001.

(51) Int. Cl.[7] ..... B05C 3/02

(52) U.S. Cl. ..... 118/410; 118/319; 118/320

(58) Field of Search ..... 118/319–321, 301, 118/406, 416, 409, 410, 411; 427/284, 285, 274; 156/578; 425/274, 270

(56) References Cited

U.S. PATENT DOCUMENTS 2,025,030 A * 12/1935 Ford
2,482,418 A * 9/1949 Jenkins
2,821,158 A * 1/1958 Brown et al.
4,449,911 A * 5/1984 Brasfiel
5,128,088 A * 7/1992 Shimomura et al.
6,562,136 B1 * 5/2003 Cheuppa et al.

* cited by examiner

*Primary Examiner*—Brenda A. Lamb
(74) *Attorney, Agent, or Firm*—Jason A. Bernstein; Powell Goldstein LLP

(57) ABSTRACT

An apparatus for coating a fabric substrate comprising a housing frame, a continuous moving conveyor moving along a generally circular path and mounted to the housing frame; a plurality of vertically oriented mandrels removably mounted on the conveyor for receiving an article to be coated; a fixed coating station adjacent the path for applying a quantity of a coating to at least a portion of the article to be coated, the coating station including a solenoid for controlling the amount and pattern of the coating substance onto the article to be coated; a pivotable arm for gripping and removing the article to be coated after the coating station, the pivotable arm including a pair of cooperating gripping members for gripping the article to be coated. The coating is a non-sticky, high coefficient of friction polymer with additional components.

12 Claims, 3 Drawing Sheets

APPARATUS AND METHOD FOR COATING AN ARTICLE

CROSS-REFERENCE TO RELATED APPLICATION

This application claims the benefit of provisional patent application No. 60/307,987, filed Jul. 26, 2001, the disclosure of which is incorporated by reference in its entirety herein.

FIELD OF THE INVENTION

The present invention relates to an apparatus for coating a fabric sleeve or substrate, preferably in the general form of a sock, with a polymer to produce a non-slip, slipper type sock, such as may be worn by acute care patients to prevent potential slipping and falling and to increase traction on garments or the like for mobility in bed.

BACKGROUND OF THE INVENTION

Attempts have been made to provide some assistance to acute care patients who have difficulty either in walking or obtaining traction while walking, but all have been found lacking in one aspect or another. A commercial product that is used at nursing homes and rehabilitation centers is one that features a sock with an array of plural upstanding elastomeric-like ribs along the sole of the sock. The problem with such a product is that the raised ribs are not particularly comfortable and can be felt through the sock when putting weight on the foot. The non-slip material used by such product has a poor coefficient of friction, thus does not provide the needed safety to the user. Finally, the types of non-slip material that are used often requires second and third processing steps to cure the material, which can add to the cost of manufacturing.

SUMMARY OF THE INVENTION

The present invention relates to an apparatus, method and the product produced by the method and the apparatus, where the apparatus and method are intended to produce a non-slip, slipper type sock or other article for medical patients who may have difficulty walking on a smooth floor, for example. The sock article of the present invention is particularly suited for acute care patients, such as that large group of senior citizens who may have undergone a joint replacement, i.e., hip or knee, where movement can be slow and unsteady. The article of present invention is also designed to be used by medical personnel or other caregivers who need footwear, often in the form of a slipper that can cover a shoe, that provides increased traction. Such traction issues can be frequently found in operating or exam rooms where body fluids may be on the floor. Since most medical facility floors are smooth and hard (to facilitate cleaning) slipping can be reduced by wearing such a shoe overcover. The present invention can be adapted or used with other articles to increase or enhance the coefficient of friction over at least a portion of the article.

The present invention offers a unique approach to producing an improved health care sock, that includes an automatic system of coating and handling. The manner by which this invention develops the improved health sock will become more apparent in the following drawings and specification.

DETAILED DESCRIPTION OF PREFERRED EMBODIMENTS

Figure 1:
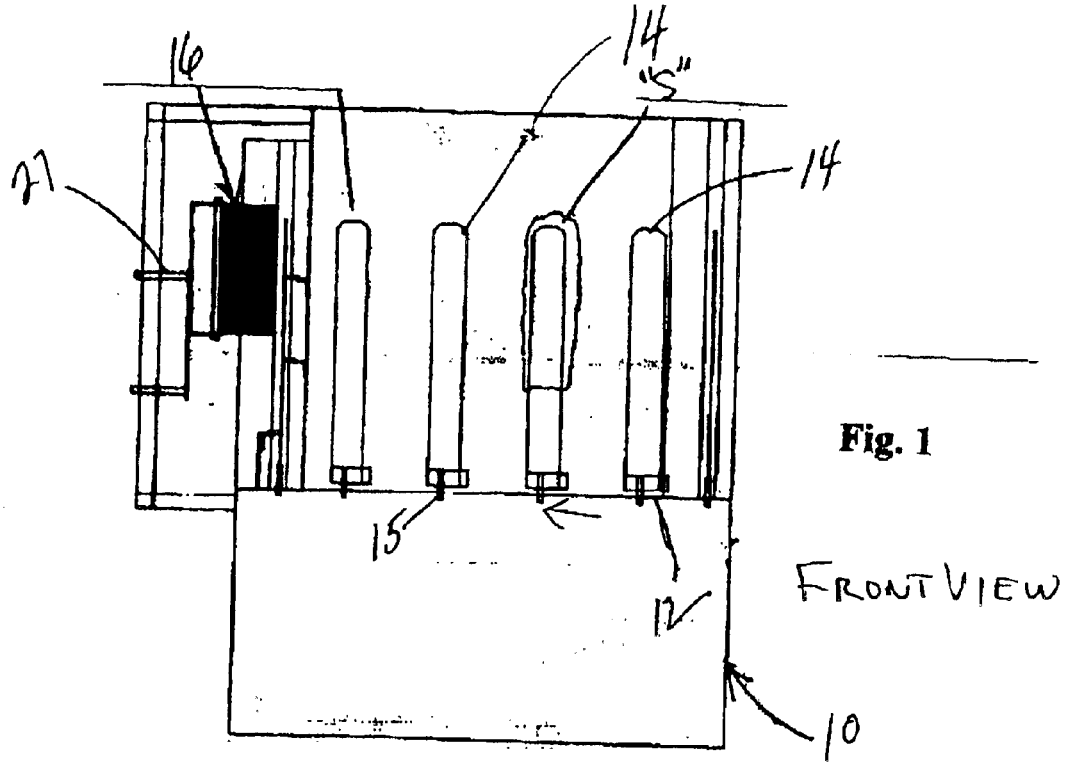
FIG. 1 is a front view of the apparatus of this invention for coating plural fabric socks positioned on a series of moving mandrels.

The present invention is directed to an apparatus to produce a non-slip, slipper type sock for medical patients, such as acute care patients who may have difficulty walking on a smooth floor. The system of this invention, in the form of a method, apparatus and the resulting slipper type sock, will now be described with regard to the accompanying drawings, where like reference numerals represent like components or features throughout the several views.

Figure 2:
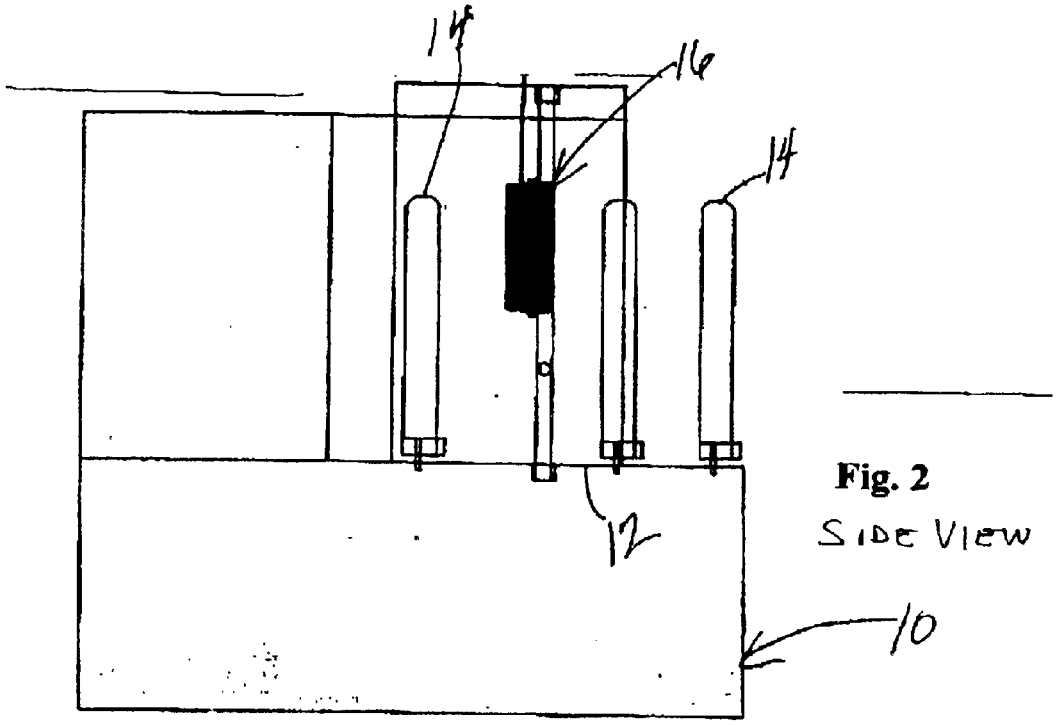
FIG. 2 is a side view of the apparatus of FIG. 1.
Figure 3:
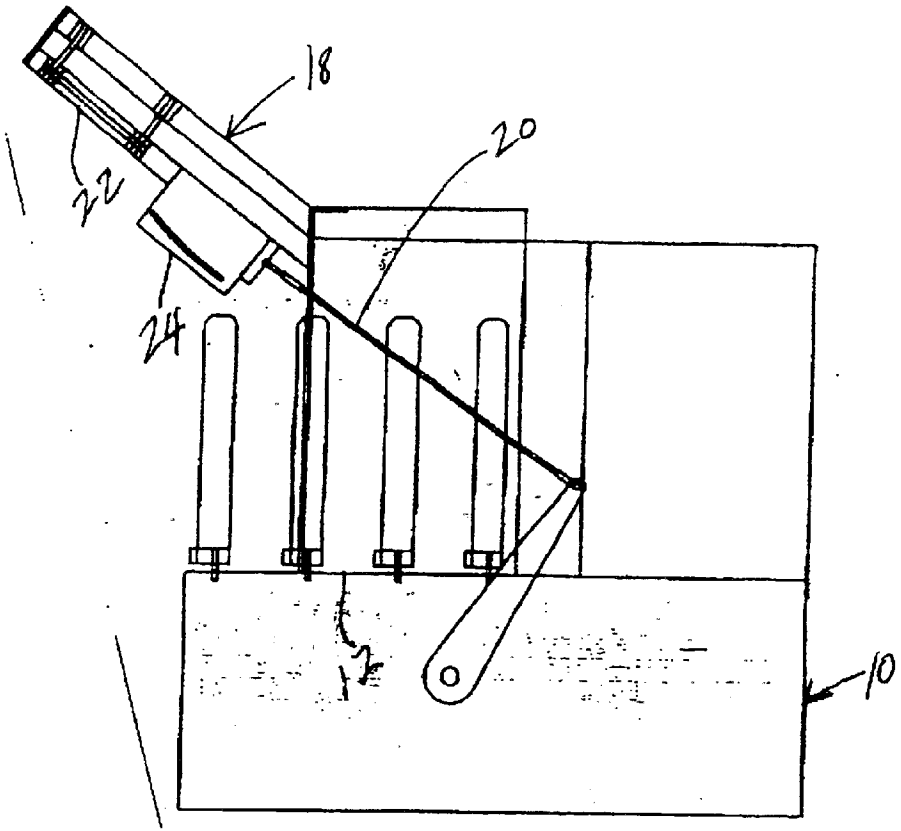
FIG. 3 is a side view down stream of the apparatus of FIGS. 1 and 2, showing a pivotal arm for gripping and removing the coated fabric socks.

Turning first to FIGS. 1 through 3, an apparatus according to a first embodiment of the present invention comprises a housing frame 10 including a continuous conveyor 12 carrying a plurality of removably mounted vertical mandrels 14, such as by insertable pins 15. The mandrel 14, preferably about 81 cm (32 inches) by about 10 cm (4 inches), provides a convenient means to slidably receive a fabric sock "S", see FIG. 1, and transport the fabric sock past a fixed coating station 16, as more fully discussed later. While a sock is used as an example of the article to be coated, it is not intended to be a limiting example. Other items, as described herein, can also be coated. As best seen in FIG. 3, the various coated fabric socks continue to move past to the coating station 16 to a sock removal station 18. The sock removal station 18 comprises a pivotable arm 20 mounting a retrieval arm 22, where the retrieval arm 22 includes a pair of gripping members 24, similar to that of a set of manually operated tongs, to grip and lift the coated fabric sock S. This opens the thus cleared mandrel 14 to return to the position of FIG. 1 to receive a new and uncoated fabric sock S.

Figure 4:
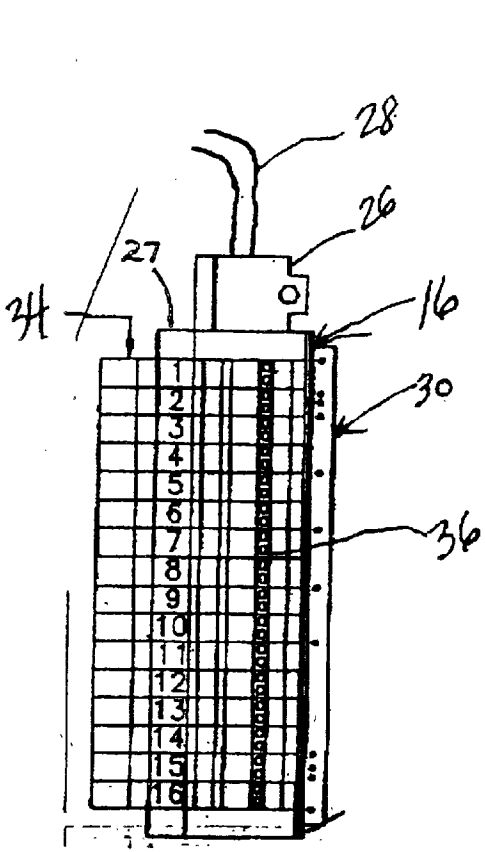
FIG. 4 is a side view of the coating mechanism, further showing a shim member to control the length of coating on the fabric sock, and a programmable solenoid to provide a variety of patterns of deposited coating substance.

As shown in FIG. 4, the coating station 16 comprises an extruder 26 mounted to a frame support 27 to which a continuous supply of a coating material, such as, but not limited to, a polymer or other tacky or high coefficient of friction substance, delivered via a hose 28, is provided for application to the fabric sock S. In a preferred embodiment, the coating material is a pressure sensitive hot melt adhesive, such as, but not limited to, ethylene vinyl alcohols (such as those made by Bostick Findley, Wawatosa, Wis., U.S.A). Further, the coating material may be characterized as a polymer with resin that is not sticky and has a high coefficient of friction. This preferred type of coating material is intended to at least partially penetrate the fabric of the sock, such as a cotton, polyester, wool, or acrylic or a blend thereof. The deposited coating material preferably does not present a surface area that might appreciably interfere with walking. Optionally or alternatively, a tackifier can be incorporated into the coating material mix. The polymer can be deposited as clear, or, alternatively, a dye material can be added to the coating material mix to add color to the coating material. Such color may be desirable for children's slippers where an aesthetically pleasing pattern (e.g., animal, shapes, words) of polymer is to be deposited. In a preferred embodiment the coating material is a combination of a styrenated block copolymer, wax, mineral oil, hydrocarbon resin and an antioxidant.

Figures 5A, 5B, 5C, 6A, 6B, 6C:
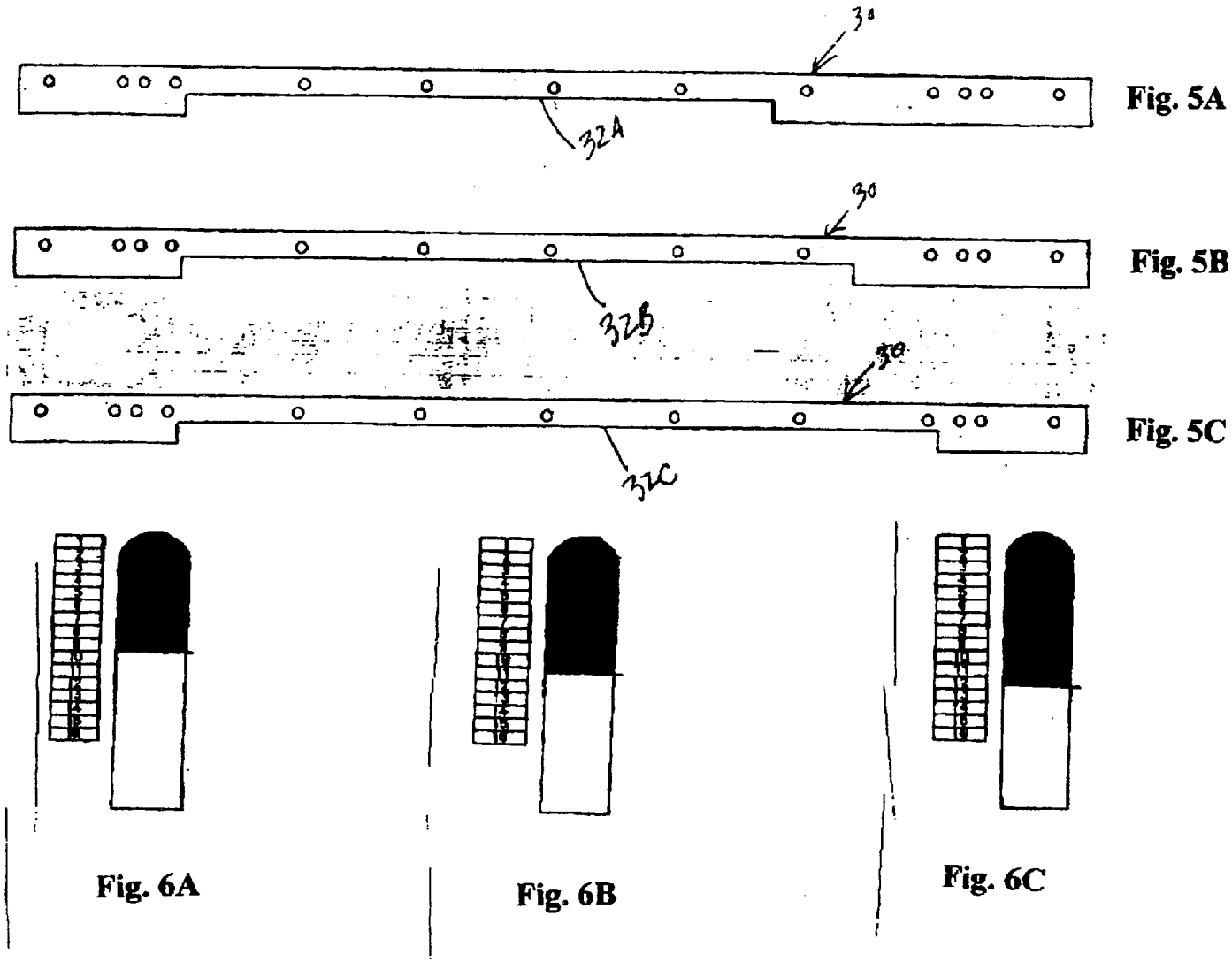
FIGS. 5A through 5C are side views showing different coating shims.
FIGS. 6A through 6C are side views illustrating exemplary coating patterns, respectively for the shims of FIGS. 5A through 5C.

The extruder 26 may be modified by mounting a shim 30, such as one made of brass (or other rigid substance), to control the area or pattern of the coating material to be applied to the fabric sock S. FIGS. 5A through 5C illustrate three different shims 30, where the respective shims 30 are characterized by different sized slots, 32A, 32B, and 32C, respectively. In other words, the length of the slots will limit the pattern of coating material to be applied to the fabric sock S. It will also be apparent that if the slot is divided by plural wall sections, the pattern can be altered as desired. FIGS. 6A through 6C schematically illustrate the covered coating material pattern on a fabric sock S using, respectively, with the shims 30 of FIGS. 5A through 5C. Additionally, the system hereof may optionally include a preprogrammed solenoid 34, with discrete modules 36 (see FIG. 4), where it is possible to deposit a unique pattern or array of deposited polymer spots or areas to suit a particular need on the article to be coated. As mentioned previously, at least a portion of the sock S is coated. The coating process can selectively coat certain areas of the sock, or other article, and can leave other areas uncoated.

The apparatus of the present invention can also be used or adapted to be used to coat other articles, such as, but not limited to, elbow or shin pads, pant seats or knee areas, shoes, boots, slippers, floor mats, towels, gloves or mitts, diapers, bookend bottoms, and the like.

Several advantages of the vertical mandrel arrangement of the present invention include automatic extraction, material set accumulation, dual coating options for both sides of the product.

The present invention also provides a method of forming a nonslip article, e.g., a sock, comprising the steps of (a) providing an apparatus as described hereinabove;
(b) inserting a sock (or other article) over one of the mandrels;
(c) passing the sock in proximity to a slot die;
(d) coating the sock with a polymer or other material extruded by the die; and,
(e) removing the sock from the mandrel for further processing, packaging or use.

The method of the present invention may further include post-forming steps, such as, but not limited to, curing, such as by heating, exposure to an ultraviolet, infrared or other light source, or the like. It is also possible to add additional coating layers by repeating the process, e.g., where a thicker coat is desired. The sock may be subjected to post-coating treatment by spraying or otherwise adding a granular material, such as, but not limited to, sand, powdered glass or other material, over the sock surface that adheres to the polymer and provides increased slip resistance.

The present invention also provides a sock or other article produced by a method comprising the steps of (a) providing an apparatus as described hereinabove;
(b) inserting a sock (or other article) over one of the mandrels;
(c) passing the sock (or other article) in proximity to a slot die;
(d) coating at least a portion of the sock (or other article) with a polymer or other material extruded by the die; and,
(e) removing the sock (or other article) from the mandrel for further processing, packaging or use.

Postprocessing steps can be as described hereinabove.

The present invention also provides an article, such as but not limited to, a nonslip sock which has a coating of a nonslip or slip resistant material on at least a portion of the surface of the article for which nonslip properties are desired.

Various patterns of discrete areas of nonslip material can be deposited on the article by altering the shape, flow rate or other property of the extruder die or coater. The die can be used to deposit dots, strips or lines or other geometric shape.

What is claimed is:

1. An apparatus for manufacturing a coated article, comprising:

a) a housing frame;
b) a continuous moving conveyor moving along a generally circular path and mounted to said housing frame;
c) a plurality of vertically oriented mandrels removably mounted on said conveyor for receiving an article to be coated;
d) a fixed coating station adjacent said path for applying a quantity of a coating to at least a portion of said article to be coated, said coating station including means for controlling the amount and pattern of said coating onto said article to be coated; and,
e) a pivotable arm for gripping and removing the coated article after said coating station, said pivotable arm including a pair of cooperating gripping members for gripping the coated article.

2. The apparatus of claim 1, wherein said article is a sock, slipper, sandal, elbow or shin pad, pants seat or knee area, shoe, boot slipper, floor mat, towel, glove, mitt, diaper, or bookend bottom.

3. The apparatus of claim 1, wherein said mandrel is associated with said conveyor by a pin.

4. The apparatus of claim 1, wherein said coating comprises a polymer resin containing that is non-sticky and has a high coefficient of friction.

5. The apparatus of claim 1, wherein said coating comprises a pressure sensitive hot melt adhesive.

6. The apparatus of claim 1, wherein said coating comprises ethylene vinyl alcohol.

7. The apparatus of claim 1, wherein said coating comprises a combination of a styrenated block copolymer, wax, mineral oil, hydrocarbon resin and an antioxidant.

8. The apparatus of claim 1, wherein said coating further comprises a tackifier.

9. The apparatus of claim 1, wherein said coating further comprises a dye.

10. An apparatus for manufacturing a coated article, comprising:

a) a housing frame;

b) a continuous moving conveyor moving along a generally circular path and mounted to said housing frame;

c) a plurality of vertically oriented mandrels removably mounted on said conveyor for receiving an article to be coated;

d) a fixed coating station adjacent said path for applying a quantity of a coating to at least a portion of said article to be coated, said coating station comprising i) an extruder for controlling the amount and pattern of said coating onto said article to be coated, ii) a solenoid, iii) at least one shim, iv) a frame support, and v) a hose for conveying said coating; and, e) a pivotable arm for gripping and removing the coated article after said coating station, said pivotable arm including a pair of cooperating gripping members for gripping the coated article, f) said coating comprising i) a combination of a styrenated block copolymer, wax, mineral oil, hydrocarbon resin and an antioxidant, ii) a tackifier, and iii) a dye.

11. The apparatus of claim 10, wherein said at least one shim is associated with said extruder for controlling the area or pattern of the coating material applied to said article.

12. The apparatus of claim 10, wherein said a solenoid is associated with said extruder for controlling the deposition of a pattern of coating onto said article.

* * * * *